US006125189A

United States Patent [19]

Yasuno et al.

[11] Patent Number: 6,125,189

[45] Date of Patent: Sep. 26, 2000

[54] ELECTROACOUSTIC TRANSDUCER OF DIGITAL TYPE

[75] Inventors: Yoshinobu Yasuno, Tokyo; Yasuhiro Riko, Yokohama, both of Japan

[73] Assignee: Matsushita Electric Industrial Co., Ltd., Osaka, Japan

[21] Appl. No.: 09/247,872

[22] Filed: Feb. 11, 1999

[30] Foreign Application Priority Data

Feb. 16, 1998 [JP] Japan ..... 10-033081
May 18, 1998 [JP] Japan ..... 10-135059

[51] Int. Cl.[7] ..... H04R 3/00; H04R 25/00

[52] U.S. Cl. ..... 381/111; 381/150

[58] Field of Search ..... 700/94; 381/111, 381/122, 112, 113, 114, 115, 116, 174, 176, 190, 191, 150

[56] References Cited

U.S. PATENT DOCUMENTS

| | | | |
|---|---|---|---|
| 3,622,791 | 11/1971 | Bernard | 250/231.19 |
| 3,626,096 | 12/1971 | Von Muench et al. | 381/191 |
| 4,422,182 | 12/1983 | Kenjyo | 359/150 |
| 4,469,920 | 9/1984 | Murphy | 381/190 |
| 4,555,797 | 11/1985 | Nieuwendijk et al. | 381/117 |
| 5,566,135 | 10/1996 | MacLeod | 367/149 |

FOREIGN PATENT DOCUMENTS

| | | |
|---|---|---|
| 0766494 | 4/1997 | European Pat. Off. . |
| 2272998 | 11/1990 | Japan . |
| 4167798 | 6/1992 | Japan . |
| 7023492 | 1/1995 | Japan . |

OTHER PUBLICATIONS

Yanagisawa "Present Existing State of Loudspeaker Directly Driven with Digital Signals", Jun. 1995, vol. 78 No. 5, pp. 565–569.

European Search Report dated Jul. 29, 1999.

Patent Abstracts of Japan, vol. 8, No. 8 (E–221), Jan. 13, 1984 & JP 58171200 A (Tokyo Shibaura Denki KK), Oct. 7, 1983.

Patent Abstracts of Japan, vol. 5, No. 3 (E–040), Jan. 10, 1981 & JP 55134597 A (Matsushita), Oct. 20, 1980.

Patent Abstracts of Japan, vol. 95, No. 11, Dec. 26, 1995 & JP 07227000A (Audio Technica Corp.), Aug. 22, 1995.

Patent Abstracts of Japan, vol. 9, No. 65 (E–304), Mar. 26, 1985 & JP 59202799A (Onkyo KK), Nov. 16, 1984.

*Primary Examiner*—Forester W. Isen
*Assistant Examiner*—Brian Tyrone Pendleton
*Attorney, Agent, or Firm*—Stevens, Davis, Miller & Mosher, L.L.P.

[57] ABSTRACT

A digital type electroacoustic transducer converts between a digital electric signal and an analog acoustic signal and includes units A (sounding bodies) arranged on the same plane as that of units B (sound receiving sensors), with the number of group units being decided at a ratio corresponding to a digit position of each bit of the digital signal. When the bit exists, a power source for electrode driving and the group unit are connected, and both of an electric/acoustic conversion and a digital/analog conversion are simultaneously executed through the unit A. The units B provide an addition value of all outputs of the units A. After a level of the detection acoustic signal is adjusted by a preamplifier, the signal is delta modulated and supplied to an arithmetic operating circuit. When a digital electric signal which is input does not exist, only the acoustic signal which arrives at the diaphragm surface of the unit B is input to the arithmetic operating circuit. A digital signal proportional to the acoustic signal is derived from a digital type electroacoustic transducer output terminal.

20 Claims, 7 Drawing Sheets

| GROUP | No. OF UNIT A |
|---|---|
| MOST SIGNIFICANT CORRESPONDING GROUP INCLUDING 32 UNITS | 1-3-4-6-7-8-10-11-13-14-18-20-22-24-25-26-28-30-31-32-37-39-41-43-44-45-47-49-54-55-57-59 |
| SECOND SIGNIFICANT CORRESPONDING GROUP INCLUDING 16 UNITS | 2-9-12-19-21-23-27-29-38-40-42-46-48-50-56-58 |
| THIRD SIGNIFICANT CORRESPONDING GROUP INCLUDING 8 UNITS | 5-15-17-34-35-51-53-60 |
| LEAST SIGNIFICANT CORRESPONDING GROUP INCLUDING 4 UNITS | 16-33-36-52 |

ELECTROACOUSTIC TRANSDUCER OF DIGITAL TYPE

BACKGROUND OF THE INVENTION

1. Field of the Invention

Among general information communication equipment, electroacoustic equipment, measuring equipment, and systems for handling an analog acoustic signal, the invention relates to an input and an output of those equipments or systems. More particularly, the invention relates to an electroacoustic transducer of a digital type which is used for a combination of an analog acoustic signal and a digitized equipment or system.

2. Description of the Related Art

Hitherto, for a combination of an acoustic signal as an analog signal and a digital equipment or system, a microphone of the analog type and an analog/digital converter are generally used additionally on the input side and a digital/analog converter and a loudspeaker or earphones of the analog type are used additionally on the output side. According to such a system, not only special electronic equipment such as analog/digital converter and digital/analog converter are necessary but also an electronic circuit, equipment, and parts adapted to both of the analog and digital types are necessary. Consequently, there are drawbacks such as increase in costs, decrease in reliability, increase in electric power consumption, and the like many items which are difficult to be technically solved such as a generation of noises due to the mixture existence of an analog signal and a digital signal and the like.

As one of the examples devised to solve the above drawbacks, a loudspeaker of a piezoelectric type which is directly driven by a digital signal has been disclosed in a document (Takesaburo Yanagisawa, "Present Existing State of Loudspeaker Directly Driven with Digital Signals", magazines of The Institute of Electronics Information and Communication Engineers of Japan, Vol. 78, No. 5, pp. 565–569, June, 1995). As schematically shown in FIGS. 10A and 10B, an electrode of the loudspeaker of the piezoelectric type is radially divided and each area (angle) is made to correspond to the position of each bit digit of a binary digital signal. FIG. 10A is a cross sectional view of an almost circular loudspeaker. FIG. 10B is a diagram showing a structure of a driving electrode on a piezoelectric diaphragm. In FIGS. 10A and 10B, reference numeral 1 denotes a piezoelectric diaphragm; 2 a stainless sheet; 3 an aluminum sheet; 4 an aluminum ring; and 5 driving electrodes divided and insulated by linear radial boundary lines 6.

However, according to the system of the loudspeaker of the piezoelectric type with such a construction, the boundaries which are divided and insulated are linear radial and are matched with the node and antinode of the natural split vibrating mode of the vibrator, namely, circular diaphragm, so that steep concave and convex portions are caused on frequency characteristics. In the example, to suppress the steep concave and convex portions, a device to attach a stainless sheet or aluminum ring with high rigidity onto a circumference or the like is made. There are, however, problems such that a structure becomes complicated, a weight of the vibrator increases, an efficiency deteriorates, and the like.

Although a digital electric signal can be converted into an analog acoustic signal under such conditions, the analog acoustic signal cannot be converted into the digital electric signal. Even if the equipment or the like is constructed by using an apparatus like the above example, therefore, since an analog signal is handled in an input, there are problems such that the problems of the noise due to the mixture existence of the analog and digital signals and the like still remain.

Also, digital microphones have been disclosed in some documents.

JP-A-2-272998 discloses a digital microphone including a diaphragm, a vibration transmitting member for transmitting vibration of the diaphragm, a conductive slider attached to a part of the vibration transmitting member and conductive patterns arranged with intervals therebetween and for touching the conductive slider along its vibrating locus. However, this digital microphone has a mechanical contact, and therefore, electroacoustic characteristics would be reduced.

JP-A-4-167798 discloses a digital microphone including a piezoelectric substrate having each surface on which a plurality of electrodes having different areas from each other are formed. An electric current value flowing from each of the electrodes, which is proportional to an area of the electrode, is compared with a threshold value so as to generate binary data. However, it is well known that a microphone of a piezoelectric type has inferior electroacoustic characteristics to that of a microphone of a condenser type.

JP-A-7-23492 discloses a digital microphone including a conductive diaphragm, a fixed electrode and an oscillator for generating an FM (frequency modulation) signal having a frequency in accordance with a capacitance formed by the conductive diaphragm and the fixed electrode. A number of pulses output from the oscillator is counted for a period of a sampling frequency and a difference between the number of pulses and reference value is calculated so as to output digital audio data. However, it is believed that this microphone is not a digital microphone but an analog microphone because the frequency modulation is an analog technique.

SUMMARY OF THE INVENTION

The invention intends to solve the problems of the conventional techniques mentioned above, and it is an object of the invention to provide an electroacoustic transducer of a digital type for directly converting from an analog acoustic signal to a digital electric signal and having transducers each for converting from a digital electric signal to an analog acoustic signal as one component. The electroacoustic transducer has excellent efficiency and frequency characteristics, and the structure is simple so as to be easily constructed.

To accomplish the above object, according to the invention, there is provided an electroacoustic transducer of a digital type, comprising (a) sounding units of a plurality of groups each including a first conductive diaphragm and at least one electrostatic driving electrode arranged almost in parallel to the first conductive diaphragm, (b) at least one sound receiving unit including a second conductive diaphragm and at least one vibration detecting electrode arranged almost in parallel to the second conductive diaphragm, (c) an electrode driving circuit for electrically connecting and disconnecting the electrostatic driving electrodes of sounding units of each group and a power source for driving the electrodes, (d) a level converting circuit for converting a level of a signal derived from at least the one vibration detecting electrode and representing a vibration displacement of the second conductive diaphragm, (e) sampling means for sampling an output signal of the level converting circuit, and (f) a driving signal supplying circuit for supplying an output of the sampling means as an electrode driving signal to the electrode driving circuit in a predetermined format.

According to the above construction, the transducer from the digital electric signal to the analog acoustic signal is constructed as one component, the digital electric signal is converted into the analog acoustic signal, and the analog acoustic signal can be directly converted into the digital electric signal.

On the surface which faces the conductive diaphragm, an electret is formed by adhering a fluororesin film onto a part or all of the surfaces of the electrostatic driving electrode and the vibration detecting electrode and giving charges thereto, or a diaphragm is formed by a fluororesin, on which a conductive material such as a metal or the like is adhered onto one surface and an electret is formed on the other surface on the opposite side, and one resultant diaphragm is adhered or two resultant diaphragms are adhered by allowing each surface on which the metal has been adhered to face each other, so that an external bias can be made unnecessary.

DESCRIPTION OF THE PREFERRED EMBODIMENTS

Some embodiments of the invention will now be described in detail hereinbelow with reference to the drawings.

The invention can be largely grasped from two aspects. The first aspect relates to electroacoustic transducing units and their combination. The second aspect relates to an electroacoustic transducer of a digital type constructed by including the electroacoustic transducing units.

Figure 1:
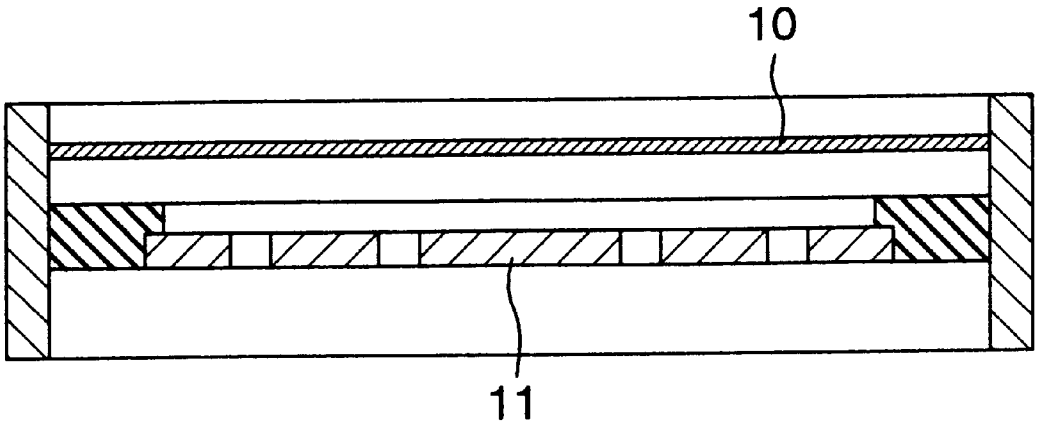
FIG. 1 is a cross sectional view on a diameter of a unit A which is used in an electroacoustic transducer according to the first embodiment of the invention.
Figure 2:
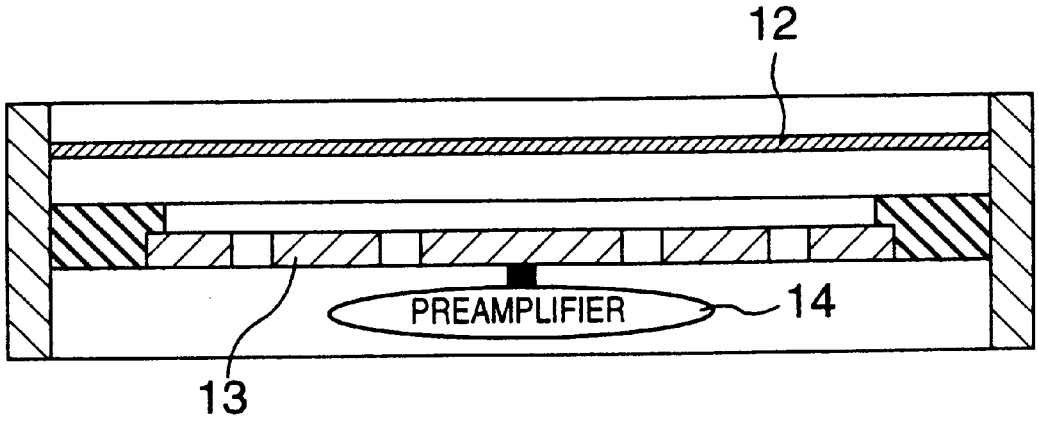
FIG. 2 is a cross sectional view on a diameter of a unit B which is used in an electroacoustic transducer according to the first embodiment of the invention.

First, the electroacoustic transducing unit according to the first aspect of the present invention comprises two kinds of a unit A as a sounding body and a unit B as a sound receiving sensor. Each of the two electroacoustic transducing units is cylindrical as a whole. FIG. 1 shows a cross sectional view on a diameter of the unit A of the electroacoustic transducer according to a first embodiment of the invention. Reference numeral 10 denotes a conductive diaphragm and 11 indicates an electrode for electrostatic driving. FIG. 2 shows a cross sectional view on a diameter of the unit B of the electroacoustic transducer. Reference numeral 12 denotes a conductive diaphragm; 13 an electrode for vibration detection; and 14 a preamplifier for impedance conversion.

Further, a fluororesin or the like is fused by a corona shower by a heat exchanger such as a corona discharge or the like and is bonded on a part of or all of the surface of the electrostatic driving electrode 11 or vibration detecting electrode 13 which face the conductive diaphragm 10 or 12 in the unit A or B and is solidified between the electrodes to which a DC voltage (polarized voltage) has been applied, thereby providing a fluororesin film on which the electret has been formed.

On the other hand, the conductive diaphragm 10 or 12 of the unit A or B is formed by a fluororesin, and then a conductive material such as a metal (for example, aluminum) or the like is adhered onto one surface of the diaphragm, and an electret is formed onto the other surface on the opposite side in a manner similar to the above, thereby forming one diaphragm. Alternatively, two diaphrams can be formed so that one surface of each diaphram on which the metal has been adhered or the electret has been formed is faced to each other. By such arrangement, an external bias becomes unnecessary. In any one of the above methods, a circuit which is electrically simple can be formed and unstable factors due to the external noises can be reduced.

Figures 3, 4:
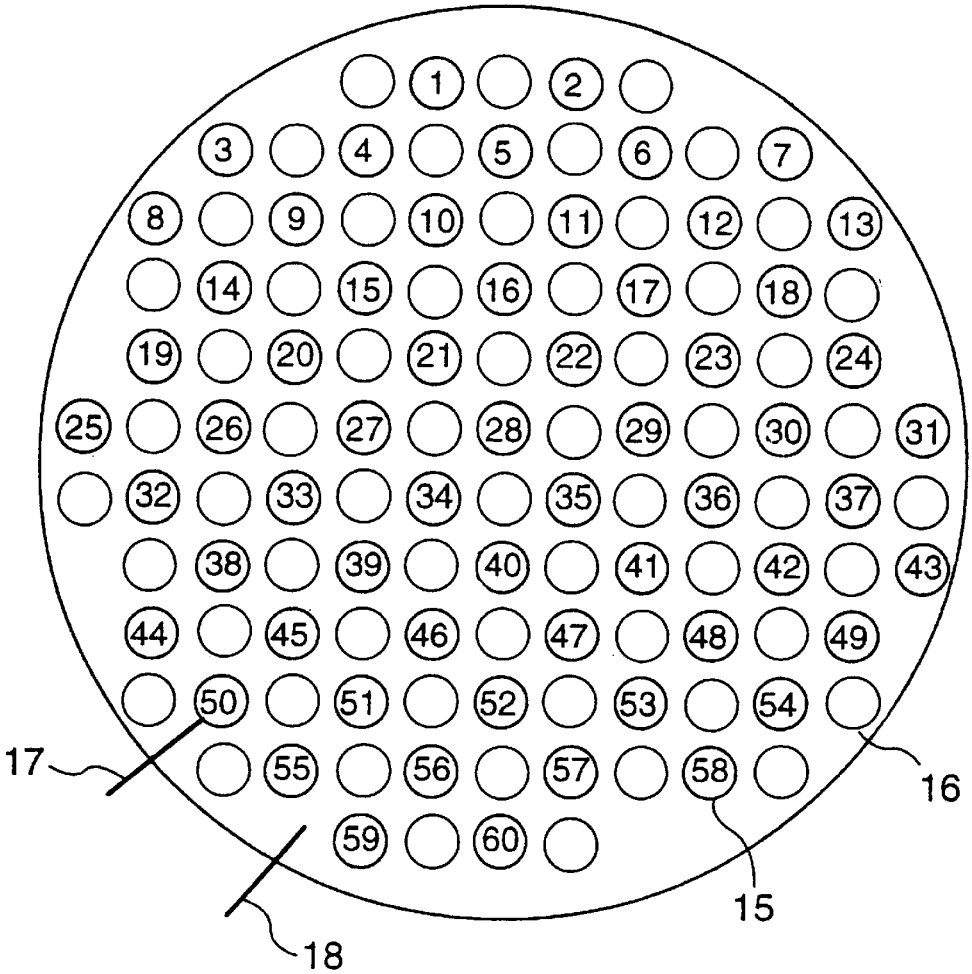
FIG. 3 is a diagram showing an example of an arrangement of a plurality of units A and a plurality of units B in the electroacoustic transducer according to the first embodiment of the invention.
FIG. 4 is a diagram showing an example of a combination of a plurality of units A in the electroacoustic transducer according to the first embodiment of the invention.

FIG. 3 shows an example of a combination in which a plurality of units A and units B of the electroacoustic transducer are used in the first embodiment. As a whole, the conductive diaphragm (hereinafter, simply referred to as a diaphragm) is arranged on the same plane. In FIG. 3, reference numeral 15 denotes units A as electroacoustic transducer sounding bodies (1 to 60), 16 units B as sound receiving sensors, 17 an electrode lead wire for electrostatic driving, and 18 an electrode lead wire for vibration detection. All of the electroacoustic transducing units are classified into a plurality of groups as shown in FIG. 4 by those lead wires on the basis of a rule, which will be explained hereinlater.

As for the unit A, in correspondence to a binary digital signal forming the acoustic signal, the numbers of units A in the respective groups are allocated by 1, 2, 4, 8, 16, 32, 64, 128, . . . , namely, at ratios represented by an exponential of "2". Thus, when the binary digital signal is given to each of the corresponding groups, a sound pressure of a magnitude according to each digit position is radiated from the diaphragm and the output sound pressures from all of the groups are synthesized in a sound field.

With respect to the magnitude of the sound pressure, the signal that is given to each group corresponds to each bit digit position and those signals are allocated as mentioned above. Therefore, when the signal (bit) exists at the relevant digit position, the output sound pressure from the group corresponding to the digit position is radiated, so that the electric/acoustic transducing step also simultaneously executes a digital/analog conversion. The converted and synthesized analog acoustic signal is detected by the unit B as a sound receiving sensor. The units B are connected so that all of the outputs are added.

Figure 5:
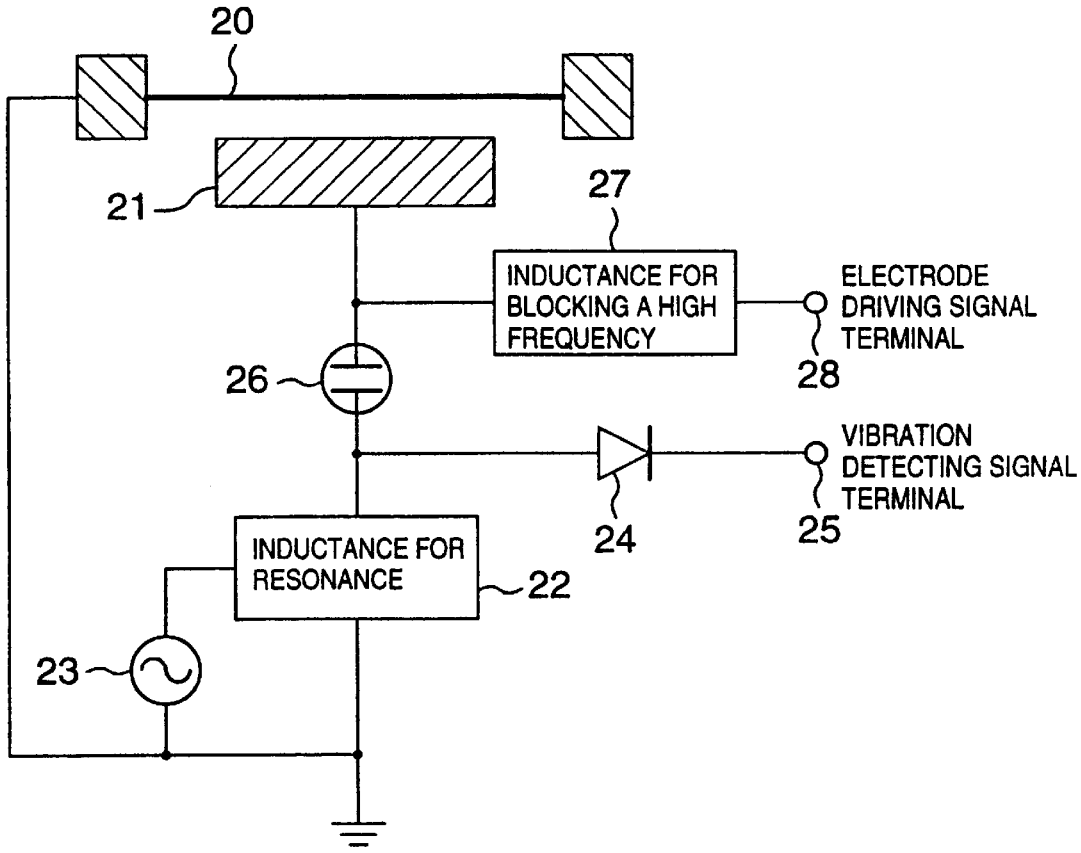
FIG. 5 is a schematic diagram showing an electroacoustic transducer according to the second embodiment of the invention.

FIG. 5 shows a construction according to a second embodiment of the invention in which the electrostatic driving electrodes and the vibration detecting electrodes can be commonly used by separating in a frequency area. FIG. 5 relates to an invention employing commonly used driving and vibration detecting electrodes which are separated in circuit from each other at each operating frequency range. In FIG. 5, reference numeral 20 denotes a conductive diaphragm, 21 a fixed electrode (for electrostatic driving or vibration detection), 22 an inductance for resonance, 23 a high frequency oscillator, 24 a rectifier, 25 a vibration detection signal terminal, 26 a capacitor for blocking a low frequency, 27 an inductance for blocking a high frequency, and 28 an electrode driving signal terminal.

An electrostatic capacitance Co which is formed by the conductive diaphragm 20 and fixed electrode 21 forms a resonance frequency $f_o$ together with the inductance for resonance. An oscillating frequency $f_g$ of the high frequency oscillator 23 slightly differs from the resonance frequency $f_o$. Now assuming that the conductive diaphragm 20 vibrates by an external sound pressure or by a driving force from the fixed electrode 21, the electrostatic capacitance Co changes and the resonance frequency $f_o$ also changes. Thus, a high frequency voltage which reaches the rectifier 24 changes in correspondence to the vibration of the conductive diaphragm 20 and the vibration can be detected by the vibration detection signal terminal 25. Consequently, when the unit B is constructed, the preamplifier 14 for impedance conversion shown in FIG. 2 is made unnecessary, so that the units A and B can be realized by the same hardware.

Figure 6:
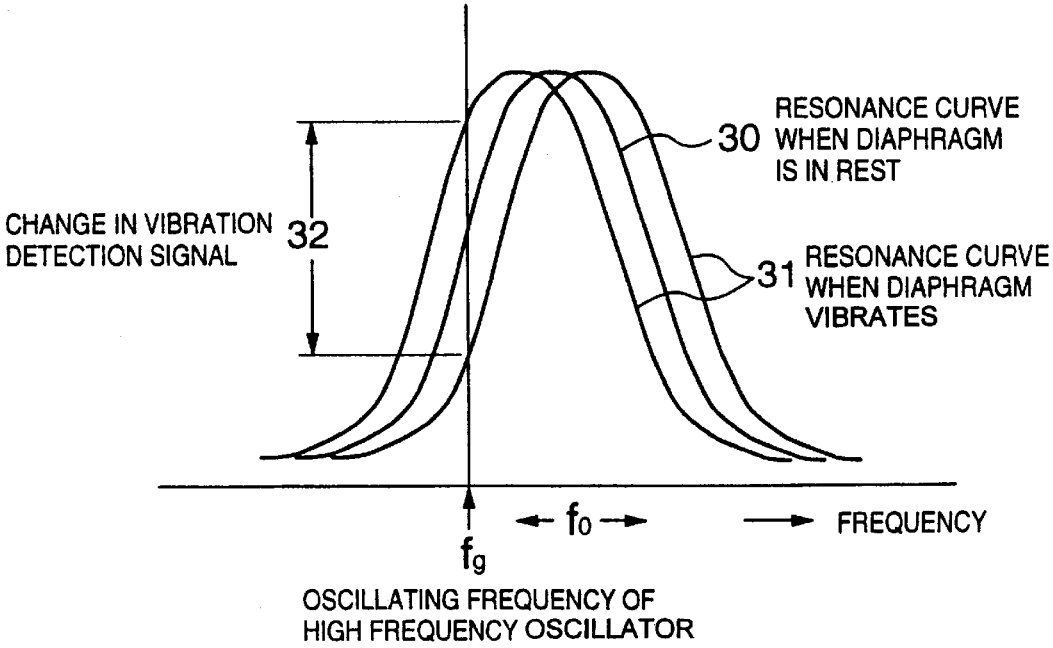
FIG. 6 is a diagram for explaining the vibration detecting operation by a change of a high frequency voltage in a unit B which is used in the electroacoustic transducer of FIG. 5.

Since the oscillating frequency $f_g$ of the high frequency oscillator 23 can be made higher than that of the electrode driving signal by about ten times, by separating in a circuit manner by the capacitor 26 for blocking the low frequency and the inductance 27 for blocking the high frequency, the electrode driving (unit A) and the vibration detection (unit B) can be constructed by the same unit. FIG. 6 shows the vibration detection by the change in high frequency voltage. In FIG. 6, reference numeral 30 denotes a resonance curve due to the electrostatic capacitance Co by the conductive diaphragm 20 and fixed electrode 21 when the diaphragm is in rest and due to the inductance 22 for resonance, 31 resonance curves when a fluctuation occurs due to the vibration of the conductive diaphragm 20, and 32 a change in vibration detection signal.

Figure 7:
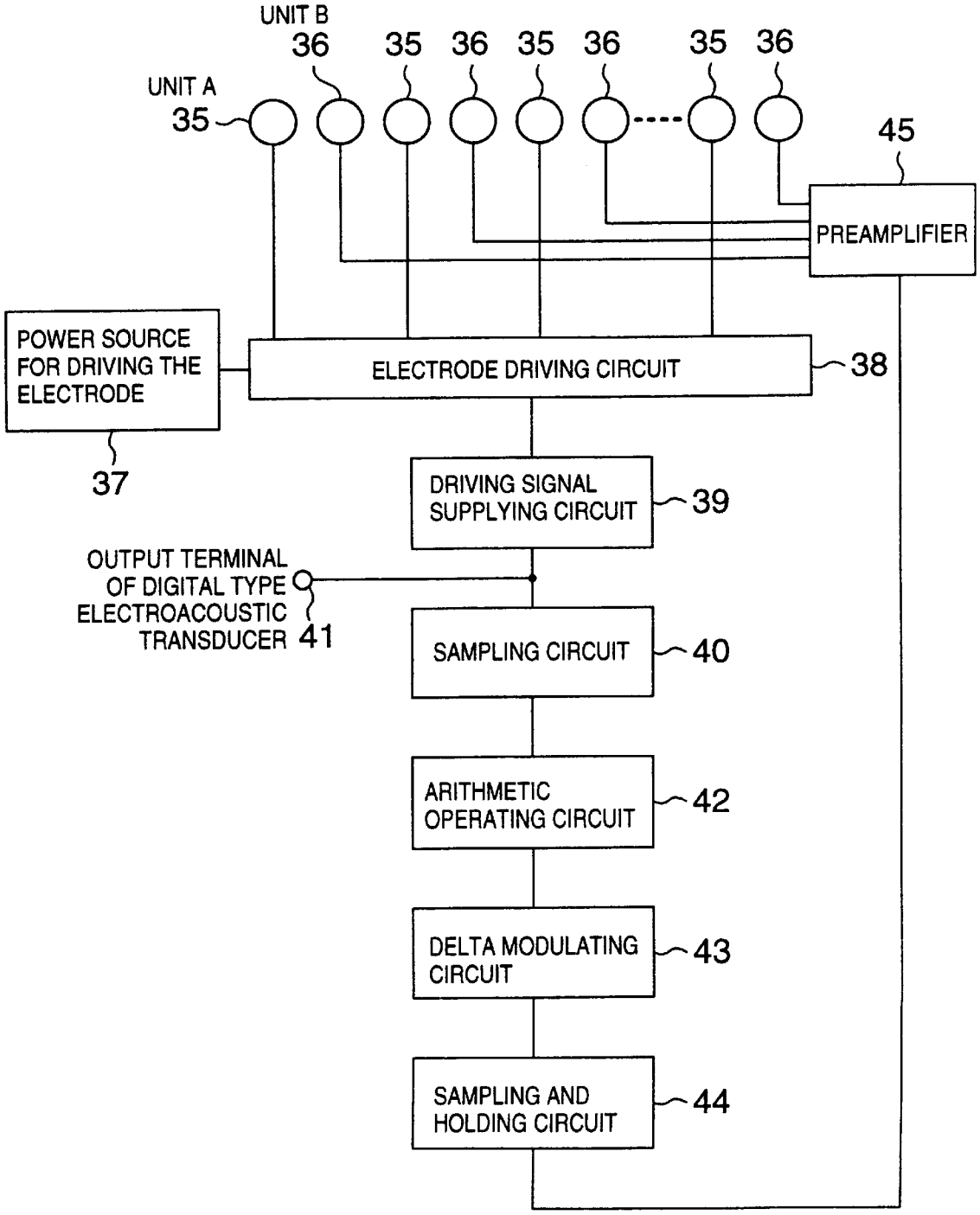
FIG. 7 is a schematic diagram showing an electroacoustic transducer according to the third embodiment of the invention.

The second aspect of the invention will now be described. FIG. 7 is a block diagram showing a schematic construction of an electroacoustic transducer of the digital type according to a third embodiment of the invention and relates to the electroacoustic transducer of the digital type constructed by including the electroacoustic transducing units mentioned in the first or second embodiment. In FIG. 7, reference numeral 35 denotes units A of the electroacoustic transducer, 36 units B, 37 a power source for driving the electrode, and 38 an electrode driving circuit for performing a connection or disconnection between the electrode driving power source 37 and electrodes of units A 35 in response to a digital driving signal which is supplied from a driving signal supplying circuit 39. Reference numeral 40 denotes a sampling circuit, 41 an output terminal of an electroacoustic transducer of the digital type (digital microphone), 42 an arithmetic operating circuit, 43 a delta modulating circuit constructed by a subtractor, a comparator, a local integrator and so on, 44 a sampling and holding circuit, and 45 a preamplifier including an impedance conversion.

In FIG. 7, the circuitry within a range from the electrode driving circuit 38 to the output terminal 41 of the digital microphone operates by a clock signal (second clock) of, for example, 44.1 kHz from a viewpoint of matching of a connection to general digital audio equipment. A circuitry within a range from the arithmetic operating circuit 42 to sampling and holding circuit 44 operates by a clock signal (first clock) of a higher frequency in consideration of characteristics of the well-known delta modulation. The matching between the two clock signals is performed by the sampling circuit 40.

The operation of the digital type electroacoustic transducer according to the third embodiment will now be described hereinbelow. In a main body of the digital type electroacoustic transducer, an electrostatic loudspeaker as a sounding body, namely, unit A 35 and an electrostatic microphone as a sound receiving sensor, namely, unit B 36 are formed in the same shape and are arranged on a plane. The electrostatic microphone and the electrostatic loudspeaker are well known. As for the microphone, it is known that its output voltage is proportional to a displacement of the diaphragm by an external sound pressure and an electret surface potential (or polarized voltage). It is also well known that an output voltage of the electrostatic loudspeaker is proportional to a driving force that is electrostatically applied to the diaphragm and its magnitude is determined by an electret surface potential (or polarized voltage) and a signal voltage which is applied from the outside and a size of an area of the driving electrode which faces the diaphragm. The numbers of group units are, accordingly, decided at ratios of $$2^0:2^1:2^2:2^3:2^4: \ldots$$
$$=1:2:4:8:16: \ldots$$

in correspondence to the digit position of each bit of the digital signal. As mentioned above, when the bits exist, the connection state between the electrode driving power source 37 of a predetermined voltage and its group unit is set to "connection" and the driving force is applied. Thus, a sound pressure of the magnitude according to the numerical value of the digital signal can be radiated. In other words, the electric/acoustic conversion through the unit A 35 and the digital/analog conversion are simultaneously executed.

In this instance, now assuming that the voltage of the applied digital electric signal is constant for all of the digit positions and the digital electric signal includes an enough high clock frequency, frequency characteristics of the driving force can be regarded to be flat.

The operation similar to that mentioned above can be also performed even if the product of the supplying voltage to each digit position and the number of units A 35 in the group is set at the above ratios.

Although the electric/acoustic conversion by the digital signal has been described above, the acoustic signal radiated as mentioned above is detected by the detecting electrodes of the units B 36. The units B 36 are distributed and arranged on the same plane as that of the units A 35 and they are mutually additively connected. Therefore, an acoustic signal which is detected becomes an addition value of the outputs of all of the units A 35. The operation of so called a delta modulation is performed after the level of the detected acoustic signal was adjusted by the preamplifier 45. That is, the signal is sampled by using a high speed clock signal and its sampling value is compared with the one-preceding value, and an output pulse is generated which is set to "+1" when a difference as a comparison result has been increased by a preset threshold value or more, to "−1" when the difference has been decreased, and to "0" when the difference lies within the threshold value (see the sampling and holding circuit 44 and delta modulating circuit 43 shown in FIG. 7). An output with the value "+1", "−1", or "0" which is derived as mentioned above is regarded as a binary number and is supplied to the arithmetic operating circuit 42.

On the basis of this value, the arithmetic operating circuit 42 adds or subtracts a driving signal and forms a new driving signal. When the digital electric signal which is supplied from the outside does not exist, a signal that is detected and supplied to the arithmetic operating circuit 42 is caused by only a vibrating force of the acoustic signal which reaches the diaphragm surface of the unit B 36 from the outside. In the arithmetic operating circuit 42, since the addition or subtraction is always performed so as to reduce the synthesized output of the unit B 36, the unit B 36 is remaining still against the acoustic signal at a precision within the range of the least significant bit of the digital signal. In other words, the average value of the pressures on the diaphragm surface which are given by the entering acoustic signal and the synthesized sound pressure that is radiated from the units A 35 via the driving signal supplying circuit 39, electrode driving circuit 38, and driving electrode from the arithmetic operating circuit 42 are balanced within a certain range of errors.

Therefore, an output of the arithmetic operating circuit 42, namely, the driving force of the units A 35 is the digitized force and has a magnitude in which a sign is opposite and which is proportional to the acoustic signal with a delay time of one sample. That is, the digital microphone is realized and is shown as a digital type electroacoustic transducer output terminal 41 in FIG. 7. In this case, as for the vibration displacement signal and its preamplifier 45, since the increase or decrease is merely observed, a degree of a requirement about the linearity is set to a degree such that a monotonous increase or decrease in a fairly narrow range is necessary.

Figure 8:
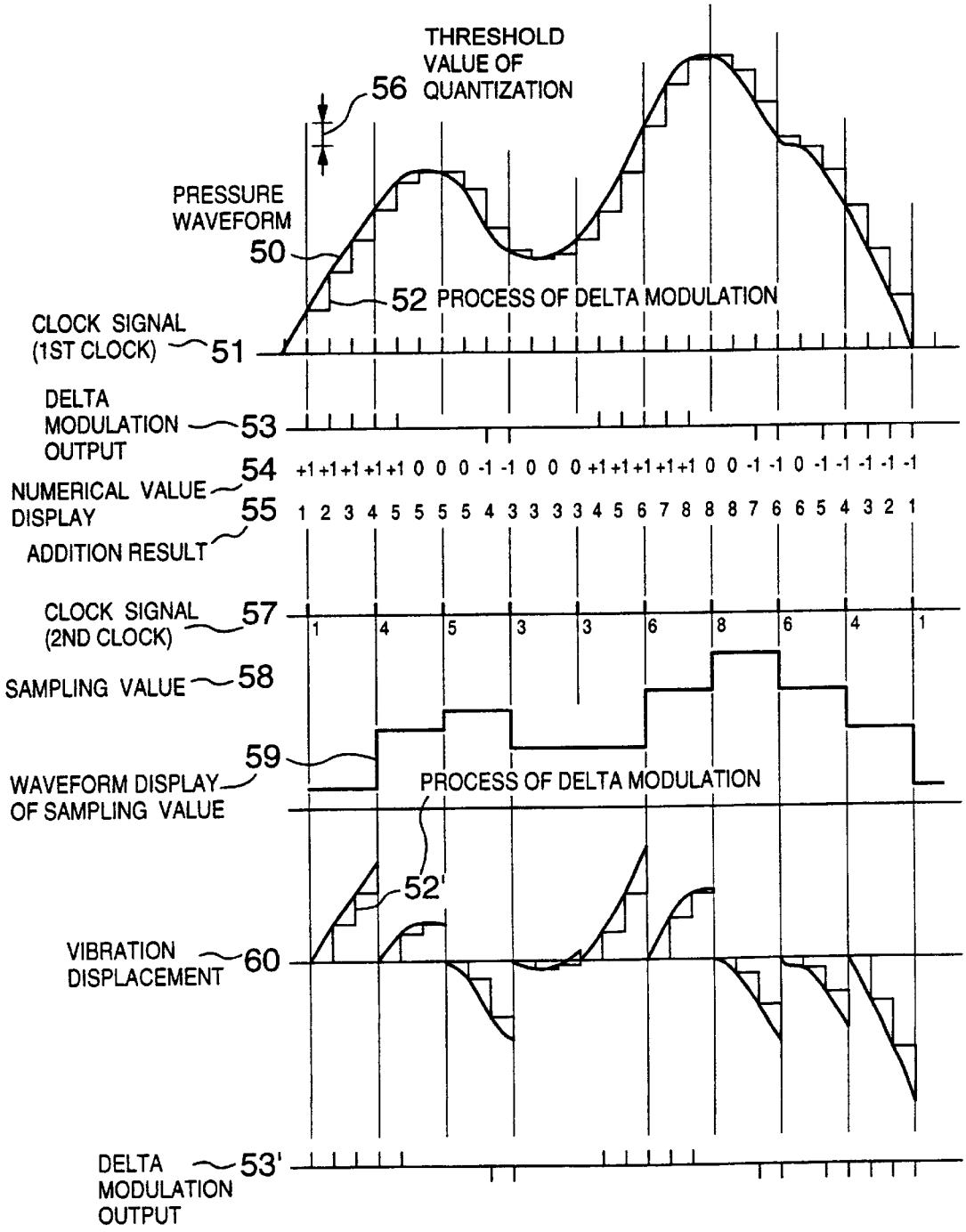
FIG. 8 is a diagram for explaining the operation of the electroacoustic transducer of FIG. 7.

FIG. 8 schematically shows the above operations. In FIG. 8, all of axes of abscissa indicate the same time base. Reference numeral 50 denotes a pressure waveform of the acoustic signal which arrives at the diaphragm, 51 a clock signal (first clock) to perform the delta modulation, 52 a process to perform the delta modulation to an input, 53 a delta modulation output, 54 numerical value displays of the delta modulation output 53, 55 results obtained by accumulating and adding the numerical value displays 54, and 56 a threshold value of quantization in the delta modulation. Further, reference numeral 57 denotes a clock signal (second clock) for connection to the outside and 58 indicates a value obtained by sampling the accumulated and added results 55 by the clock signal 57. The value 58 becomes an electrode driving signal and, at the same time, becomes a digital microphone output signal.

Reference numeral 59 denotes a waveform display having a shape obtained by sampling the inputted pressure waveform 50. Reference numeral 60 denotes a driving force obtained by synthesizing the driving force for the diaphragm by the signal and the input sound pressure and also indicates a vibration displacement of the diaphragm that is proportional to such a driving force, 52' a delta modulating process for the vibration displacement, and 53' a result of this process. Obviously, the result 53' is the same as the result shown in the delta modulation output 53.

Figure 9A:
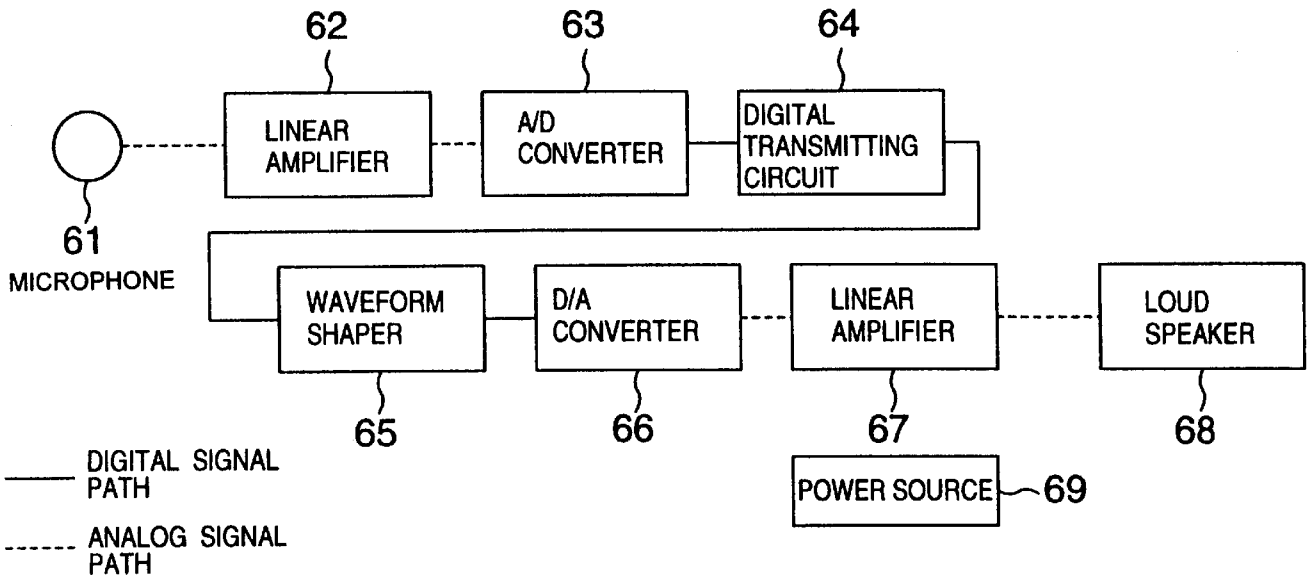
FIG.9A PRIOR ART
FIG. 9A is a diagram showing a conventional voice communication system.
Figure 9B:
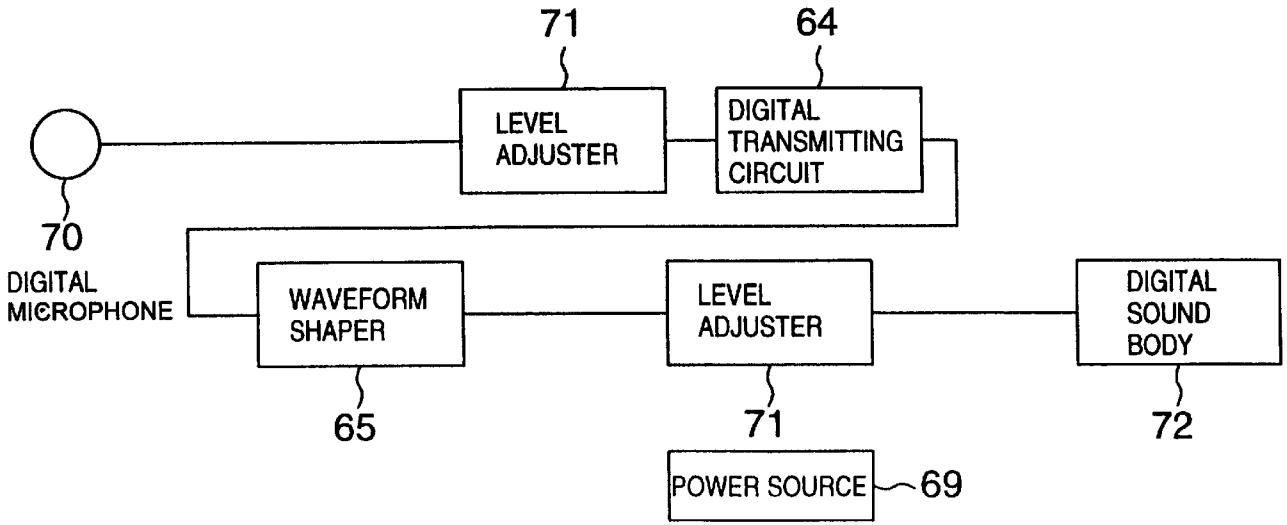
FIG. 9B is a diagram showing a voice communication system using an electroacoustic transducer according to the invention.
Figure 10A:
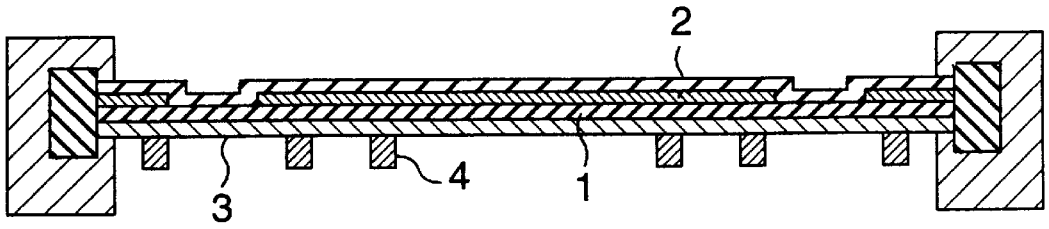
FIG.10A PRIOR ART
FIG. 10A is a cross sectional view showing a conventional circular loudspeaker.
Figure 10B:
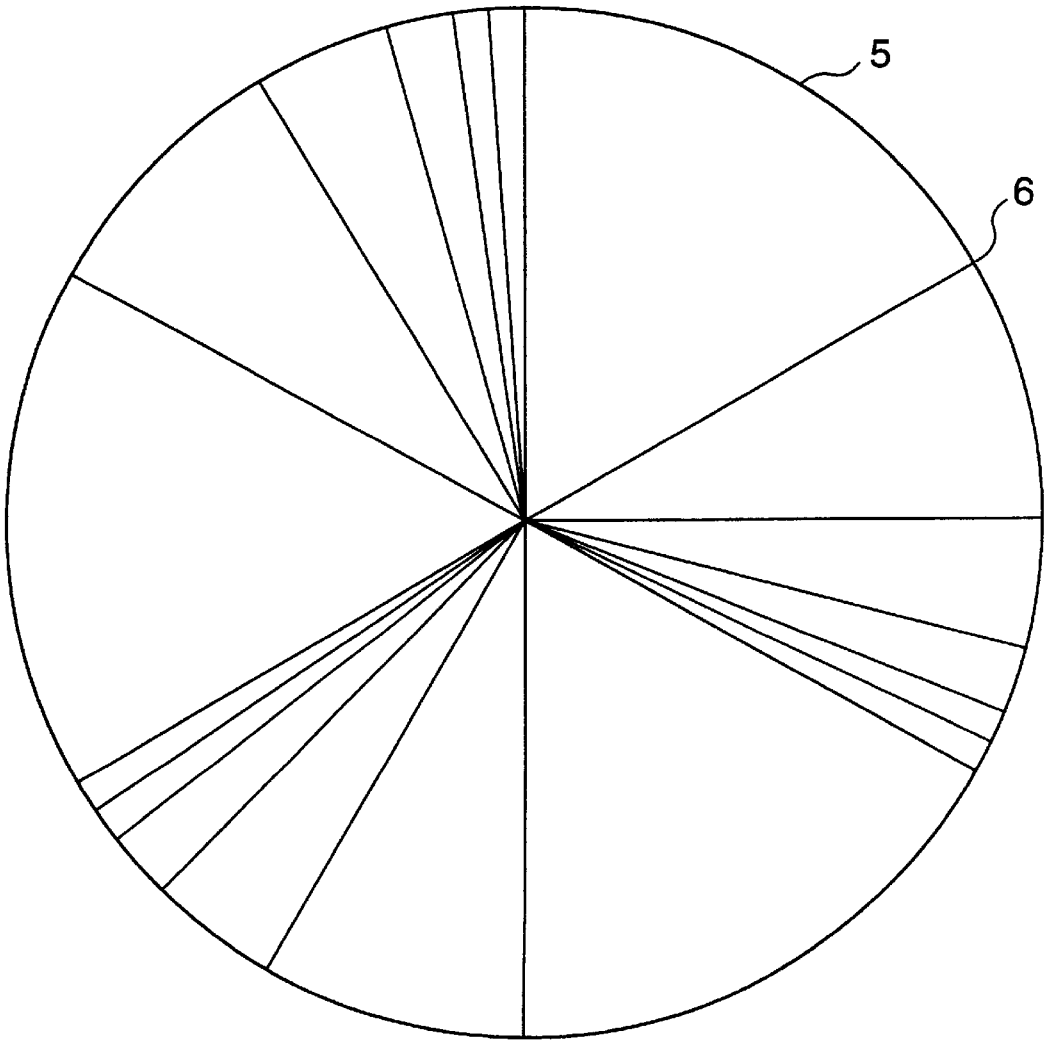
FIG.10B PRIOR ART
FIG. 10B is a plan view showing a structure of a driving electrode on a piezoelectric diaphragm of the conventional circular loudspeaker.

As described above, the digital type electroacoustic transducer of the invention can be applied to all of a voice communication system, acoustic equipment, and the like. As simple examples in such a case, voice transmission systems each having a digital transmission path are shown in FIGS. 9A and 9B. FIG. 9A shows an example of a voice communication system according to the conventional technique. FIG. 9B shows an example of a voice communication system using the digital type electroacoustic transducer of the invention. In FIGS. 9A and 9B, reference numeral 61 denotes a microphone by the conventional technique, 62 and 67 linear amplifiers, 63 an analog/digital converter, 64 a digital transmitting circuit, 65 a waveform shaper, 66 a digital/analog converter, 68 a loudspeaker according to the conventional technique, 69 a power source of the system, 70 a digital microphone according to the invention, 71 (two) level adjusters of the digital signal, and 72 a sounding body of the digital type mentioned in the invention. In FIGS. 9A and 9B, a broken line denotes an analog signal path and a solid line indicates a digital signal path.

As shown in FIG. 9B, as will be understood because the whole voice communication system has been digitized, the analog/digital converter 63 and digital/analog converter 66 shown in FIG. 9A are omitted. Consequently, the obstacles such as noises, inductive interference, and the like due to the mixture existence of the analog circuit and the digital circuit can be eliminated.

According to the invention as described above, since the whole system has been digitized, the circuits such as A/D converter, D/A converter, and the like can be removed. This is because the digital type electroacoustic transducer in the invention has the functions of both of the analog/digital conversion and the digital/analog conversion. This provides various advantages. Technically, there are many useful advantages such that the system is made free from the obstacles such as noises, inductive interference, and the like due to the mixture existence of the analog circuit and the digital circuit, the costs are reduced owing to the standardization of parts, non-adjustment, and the like in terms of the costs, further, the high reliability is realized due to the decrease in the number of parts from a viewpoint of the use of the equipment system, and the like. It will be obviously understood that an explanation about the social and technical superiority as a result of the digitization of various equipment and system can be omitted here.

What is claimed is:

1. An electroacoustic transducer of a digital type, comprising:

sounding units of a plurality of groups each including a first conductive diaphragm and at least one electrostatic driving electrode arranged almost in parallel to said first conductive diaphragm;

at least one sound receiving unit including a second conductive diaphragm and at least one vibration detecting electrode arranged almost in parallel to said second conductive diaphragm;

an electrode driving circuit for electrically connecting or disconnecting between said electrostatic driving electrodes of said sounding units of each group and a power source for driving the electrodes;

a level converting circuit for converting a level of a signal derived from said at least one vibration detecting electrode and representing a vibration displacement of said second conductive diaphragm;

sampling means for sampling an output signal of said level converting circuit; and a driving signal supplying circuit for supplying an output of said sampling means as an electrode driving signal to said electrode driving circuit in a predetermined format.

2. A transducer according to claim 1, further comprising a plurality of said sound receiving units arranged on an almost same plane as that of said sounding units of said plurality of groups.

3. A transducer according to claim 1, wherein said at least one sound receiving unit includes an impedance converting circuit electrically connected to said at least one vibration detecting electrode.

4. A transducer according to claim 1, wherein said sampling means comprises:

means for sampling the output signal of said level converting circuit by using a first clock signal;

delta modulating means for comparing a value of said sampled output signal with one-preceding value and outputting one of code pulses "+1", "−1", and "0" on the basis of a comparison result by using a predetermined threshold value; and means for accumulatively adding the code pulses outputted from said delta modulating means and sampling an addition result by using a second clock which is matched to external equipment that is electrically connected to said electroacoustic transducer of the digital type.

5. A transducer according to claim 4, wherein said first clock signal has a frequency that is at least twice as high as that of said second clock signal.

6. A transducer according to claim 1, wherein a number of sounding units included in an n-th group among said sounding units of said plurality of groups is proportional to $2^n$.

7. A transducer according to claim 1, wherein a product of a number of sounding units included in an n-th group among said sounding units of said plurality of groups and a voltage of said power source which is supplied to the sounding units of said n-th group is proportional to $2^n$ in correspondence to a position of a bit digit of an input digital signal.

8. A transducer according to claim 1, wherein an electrostatic capacitance which is formed by said at least one vibration detecting electrode and said second conductive diaphragm constructs a part of a resonance circuit which resonates at a frequency that is at least ten times as high as that of the electrode driving signal in said at least one electrostatic driving electrode, and a change in said electrostatic capacitance which is caused by a vibration of said second conductive diaphragm is converted into a change in electric signal and is used as said signal showing the vibration displacement of said second conductive diaphragm.

9. A transducer according to claim 1, wherein each of said at least one electrostatic driving electrode and said at least one vibration detecting electrode includes a film attached to at least a part of a surface which faces a respective one of said first and second conductive diaphragms and on which an electret has been formed while adhering charges thereto.

10. A transducer according to claim 9, wherein said film includes a fluororesin film onto which the charges have been adhered by a corona shower.

11. A transducer according to claim 1, wherein each of said first and second conductive diaphragms includes a film on which an electret has been formed by adhering a conductive material to one surface and adhering charges to the other surface.

12. A transducer according to claim 11, wherein said film includes a fluororesin film onto which the charges have been adhered by a corona shower.

13. A transducer according to claim 1, wherein each of said first and second conductive diaphragms includes two films on each of which an electret has been formed by adhering a conductive material to one surface and adhering charges to the other surface, and said two films are adhered to each other on said one surface adhered with said conductive material.

14. A transducer according to claim 13, wherein each of said two films includes a fluororesin film onto which the charges have been adhered by a corona shower.

15. A transducer according to claim 1, wherein each of said first and second conductive diaphragms includes two films on each of which an electret has been formed by adhering charges to one surface, and said two films are adhered to each other on said one surface adhered with said charges.

16. A transducer according to claim 15, wherein each of said two films includes a fluororesin film onto which the charges have been adhered by a corona shower.

17. An electroacoustic transducer of a digital type, comprising:

electroacoustic transducer units of a plurality of groups each including a conductive diaphram and at least one fixed electrode arranged almost in parallel to said conductive diaphram;

a first inductance having a first terminal electrically connected to said fixed electrode of at least one electroacoustic transducer unit and a second terminal for receiving an electrode driving signal so as to block a high frequency;

a capacitor having a first terminal electrically connected to said fixed electrode of at least one electroacoustic transducer unit so as to block a low frequency;

a second inductance electrically connected between a second terminal of said capacitor and said conductive diaphragm of at least one electroacoustic transducer unit to form a serial resonance circuit with an electrostatic capacitance formed by said conductive diaphragm and said fixed electrode;

signal supplying means for supplying a signal having a predetermined frequency to said serial resonance circuit; and vibration detecting means for detecting vibration of said conductive diaphragm on the basis of a voltage of at least one point of said serial resonance circuit to output a vibration detection signal.

18. A transducer according to claim 17, wherein said predetermined frequency is at least ten times as high as that of said electrode driving signal.

19. A transducer according to claim 17, wherein a number of electroacoustic transducer units included in an n-th group among said electroacoustic transducer units of said plurality of groups is proportional to $2^n$.

20. A transducer of a digital type according to claim 17, wherein a product of a number of electroacoustic transducer units included in an n-th group among said electroacoustic transducer units of said plurality of groups and a voltage of said electrode driving signal which is supplied to the electroacoustic transducer units of said n-th group is proportional to $2^n$ in correspondence to a position of a bit digit of an input digital signal.

* * * * *

UNITED STATES PATENT AND TRADEMARK OFFICE

CERTIFICATE OF CORRECTION

PATENT NO. : 6,125,189

DATED : September 26, 2000

INVENTOR(S) : Yoshinobu YASUNO et al.

It is certified that error appears in the above-identified patent and that said Letters Patent are hereby corrected as shown below:

The second assignee that was omitted in the title page under [73] should appear as follows:

[73] Assignees: Matsushita Electric Industrial Co., Ltd., Osaka, Japan;
Yasuhiro RIKO, Kanagawa, Japan

Signed and Sealed this

Eighth Day of May, 2001

*Attest:*

Nicholas P. Godici

NICHOLAS P. GODICI

*Attesting Officer*

*Acting Director of the United States Patent and Trademark Office*